US007643646B2

(12) United States Patent
Fielding, Jr.

(10) Patent No.: US 7,643,646 B2
(45) Date of Patent: Jan. 5, 2010

(54) LANYARD ASSEMBLY FOR AUDIO DEVICE

(76) Inventor: Jerry Fielding, Jr., 11325 Guyn Dr., Brighton, MI (US) 48114

( * ) Notice: Subject to any disclaimer, the term of this patent is extended or adjusted under 35 U.S.C. 154(b) by 942 days.

(21) Appl. No.: 11/288,460

(22) Filed: Nov. 29, 2005

(65) Prior Publication Data

US 2007/0121987 A1 May 31, 2007

(51) Int. Cl.
*H04R 1/00* (2006.01)
*H04R 25/00* (2006.01)

(52) U.S. Cl. ..... 381/385; 381/374

(58) Field of Classification Search ..... 381/374, 381/377, 379, 385
See application file for complete search history.

(56) References Cited

U.S. PATENT DOCUMENTS

| | | | | |
|---|---|---|---|---|
| 1,983,928 | A | 12/1934 | Brown | 179/107 |
| 4,070,553 | A | 1/1978 | Hass | 179/157 |
| 4,485,276 | A | 11/1984 | Sato | 179/157 |
| 4,864,619 | A | 9/1989 | Spates | 381/25 |
| 4,864,646 | A | 9/1989 | Nesbit et al. | 455/344 |
| 4,993,065 | A | 2/1991 | Chiou | 379/430 |
| 5,257,420 | A | 11/1993 | Byrne, Jr. | 2/209 |
| 5,329,592 | A | 7/1994 | Altman | 381/25 |
| 5,438,698 | A | 8/1995 | Burton et al. | 455/351 |
| RE35,051 | E | 10/1995 | Moore | 381/183 |
| 5,677,948 | A | 10/1997 | Meister | 379/142 |
| 5,715,323 | A | 2/1998 | Walker | 381/187 |
| 5,737,436 | A | 4/1998 | Boyden | 381/187 |
| 6,253,183 | B1 | 6/2001 | Boucard | 704/272 |
| D466,100 | S | 11/2002 | Obata et al. | D14/167 |
| D467,240 | S | 12/2002 | Ruohonen | D14/223 |
| 6,690,808 | B2 | 2/2004 | Urwyler | 381/381 |
| 6,707,924 | B1 * | 3/2004 | Okiebisu | 381/385 |
| 6,744,901 | B2 | 6/2004 | Ito et al. | 381/374 |
| 6,898,295 | B2 | 5/2005 | Inamura et al. | 381/385 |
| 7,236,751 | B2 * | 6/2007 | Ono | 381/385 |
| 2002/0090099 | A1 | 7/2002 | Hwang | 381/312 |
| 2002/0173346 | A1 | 11/2002 | Wang | 455/568 |
| 2003/0104842 | A1 | 6/2003 | Choi et al. | 455/569 |
| 2004/0180631 | A1 | 9/2004 | Lim et al. | 455/90.3 |
| 2005/0127123 | A1 | 6/2005 | Smithers | 224/610 |

OTHER PUBLICATIONS

International Search Report (PCT/US2006/045651) dated Sep. 26, 2007.

* cited by examiner

*Primary Examiner*—Brian Ensey
(74) *Attorney, Agent, or Firm*—Harness, Dickey & Pierce, P.L.C.

(57) ABSTRACT

A lanyard assembly can include a primary lanyard adapted to be worn around the neck of a user and a secondary lanyard positioned proximate the primary lanyard. The secondary lanyard can include a wire for providing audio transmission, a plug carried by the secondary lanyard proximate a first end of the secondary lanyard and connected to the wire, and an audio output device carried by the secondary lanyard proximate a second end of the secondary lanyard and connected to the wire. The lanyard assembly may further include a fastening arrangement. The fastening arrangement can include first and second cooperating fastening components. The first fastening component may be carried on the primary lanyard, and the second fastening component may be carried on the secondary lanyard proximate one of the plug and the audio output device. The user can selectively engage and disengage the first fastening component with the second fastening component.

20 Claims, 5 Drawing Sheets

LANYARD ASSEMBLY FOR AUDIO DEVICE

FIELD

The present disclosure relates generally to audio devices. More particularly, the present disclosure relates to headsets and similar devices for use with portable audio devices such as portable music players and cellular phones. The present disclosure also more particularly relates to lanyards and similar items.

DISCUSSION

In recent times, there has been a proliferation of use of portable audio devices such as portable music players and cellular phones. Such devices are used in many situations and for many personal and business purposes. Known portable audio devices include but are not limited to cellular phones, portable music players, electronic games, laptop computers, dictation recorders (such as DICTAPHONES®), and other devices.

Portable audio devices can employ headsets, headphones, and similar devices. For instance, cellular phones can be used with headsets, a variety of which are known in the art. Headsets can each include a speaker to be worn in or near one or both of the ears of a user and a microphone to pick up the voice of the user. Headsets are typically connected to cellular phones via cords. Headsets can be desirable to free the hands of users, to keep antennas of cellular phones away from heads of users, and to improve communication. In another example, portable music players can be used with headphones, a variety of which are known in the art. Headphones can provide speakers in or near the ears of a user and can provide for stereo listening. Headphones typically have a cord from the speakers to a plug.

Conventional cords for headsets, headphones, and similar devices may be associated with disadvantages. Such cords can become entangled during use, can be inconvenient to store when not in use, and may become easily misplaced. These problems can be compounded by the concurrent use of items such as lanyards. For example, lanyards and cords can become entangled with each other. As lanyards and similar items are also used in many situations and for many purposes, it would be desirable to minimize these disadvantages.

Accordingly, there remains a need in the pertinent art to provide an assembly incorporating a headset or a similar device with a lanyard or a similar item which overcomes the disadvantages and limitations associated with the known prior art, including but not limited to those disadvantages and limitations discussed above.

SUMMARY

The present disclosure provides a lanyard assembly. The lanyard assembly can include a primary lanyard adapted to be worn around the neck of a user, a secondary lanyard positioned proximate the primary lanyard and including a wire for providing audio transmission, a plug carried by the secondary lanyard proximate a first end of the secondary lanyard and connected to the wire, an audio output device carried by the secondary lanyard proximate a second end of the secondary lanyard and connected to the wire, and a fastening arrangement. The fastening arrangement can include first and second cooperating fastening components. The first fastening component can be carried on the primary lanyard, and the second fastening component can be carried on the secondary lanyard proximate one of the plug and the audio output device. The user can selectively engage and disengage the first fastening component with the second fastening component.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DISCUSSIONS OF VARIOUS ASPECTS

The following description will be understood to be merely exemplary in nature and is in no way intended to limit the disclosure, its application, or uses.

Figure 1:
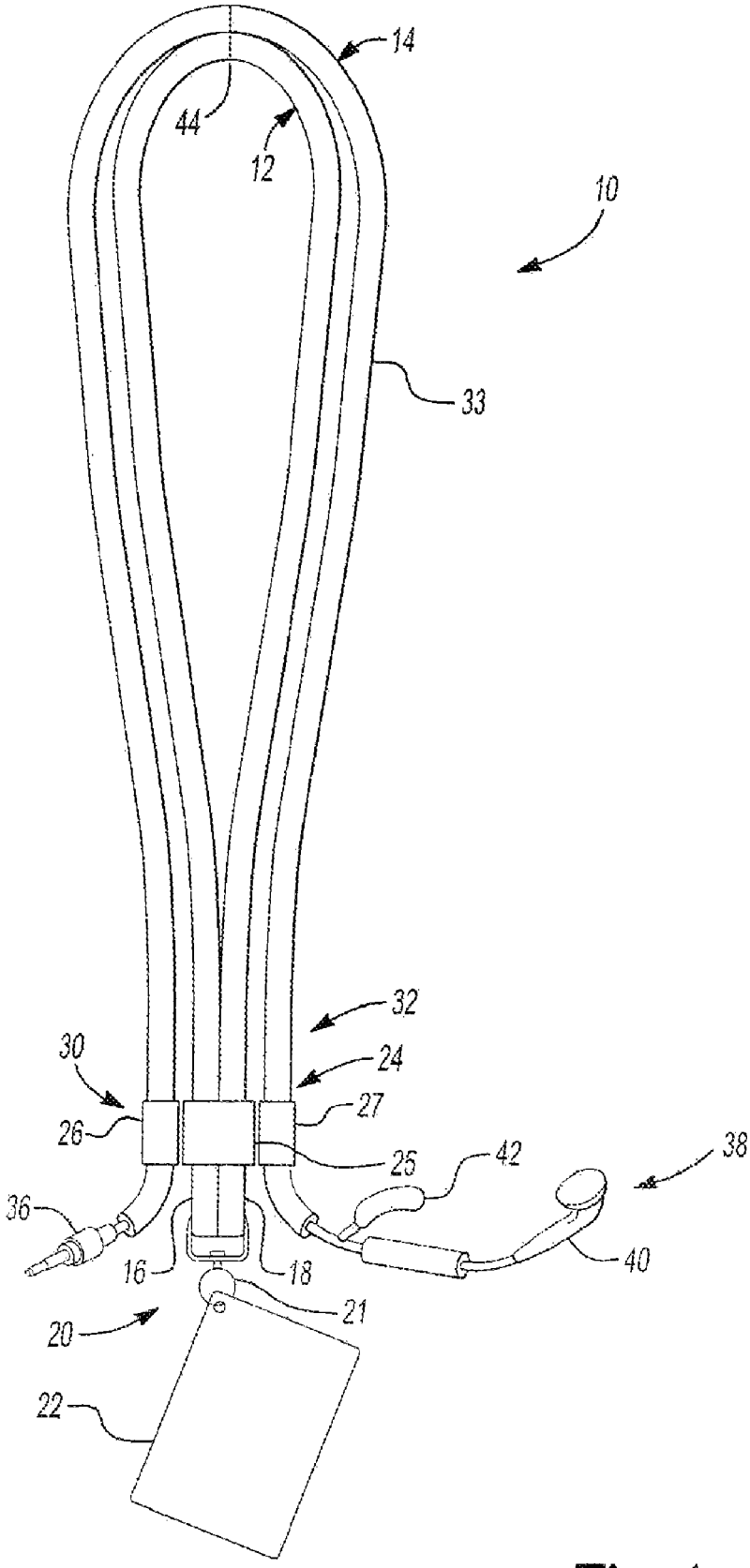
FIG. 1 illustrates a lanyard assembly constructed in accordance with the teachings of the present disclosure, a secondary lanyard shown with first and second ends removably secured to a primary lanyard.
Figure 2:
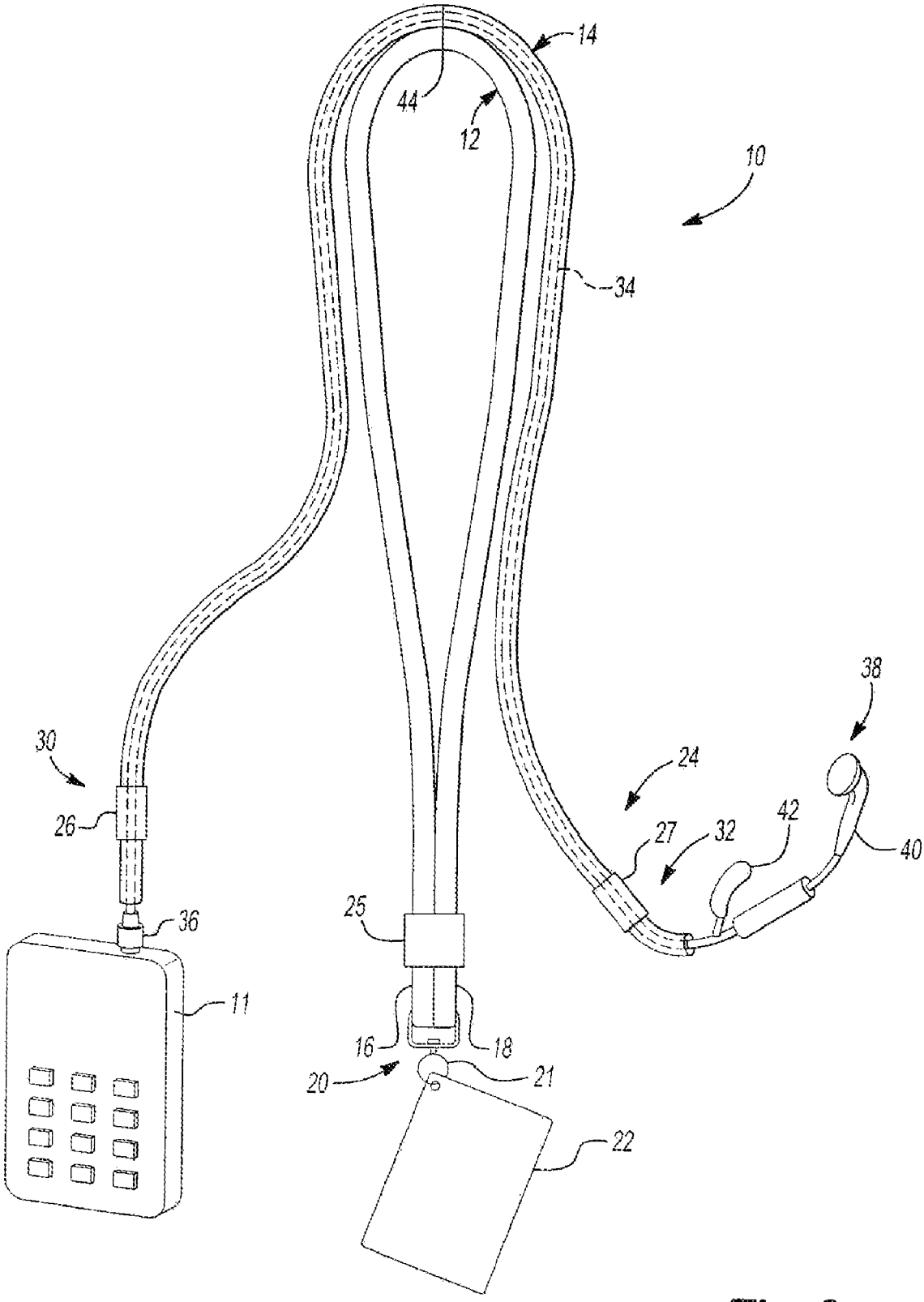
FIG. 2 is a view similar to FIG. 1, illustrating the first and second ends of the secondary lanyard detached from the primary lanyard and the secondary lanyard operatively associated with a portable audio device.

With initial reference to FIGS. 1 and 2 of the drawings, a lanyard assembly constructed in accordance with the teachings of the present disclosure is illustrated and generally identified at reference 10. The lanyard assembly 10 is shown operatively associated with a portable audio device 11. The portable audio device is illustrated as a cellular phone 11. It will be understood, however, that the teachings of the present disclosure may be used with any type of portable audio device, including but not limited to cellular phones, portable music players, electronic games, laptop computers, dictation recorders (such as DICTAPHONES®), and other devices.

The lanyard assembly 10 is illustrated to generally include a first or primary lanyard 12 and a second or secondary lanyard 14. Insofar as the present disclosure is concerned, the first lanyard 12 will be understood to be conventional in construction to the extent not specifically described herein. Prior to describing the construction and operation of the second lanyard 14, an understanding of the first lanyard 12 and the components related thereto is warranted. The first lanyard 12 is generally illustrated to be formed into a loop to be worn around the neck of a user. The first lanyard 12 can be conventionally constructed from materials well known in the art.

As illustrated in FIGS. 1 and 2, the first lanyard 12 forms a loop as a first end 16 and a second end 18 are coupled. The first and second ends 16 and 18 may be coupled to one another at an attachment assembly 20 for an accessory component 22.

The attachment assembly 20 may include a loop 21. Insofar as the present disclosure is concerned, the attachment assembly 20 will be understood to be conventional in construction. Additionally, as shown in FIGS. 1 and 2, the accessory component may be an identification card 22. It will be understood, however, that the teachings of the present disclosure are intended to be used with a variety of accessory components, as well as a variety of attachment assemblies.

The second lanyard 14 cooperates with the first lanyard 12 to provide a readily accessible earpiece for the audio device 11. The second lanyard 14 may include a first end 30 and a second end 32. A wire 34 may extend between the first and second ends 30 and 32. The first end 30 may include a plug 36. The second end 32 may include a headset 38.

Referring again to FIGS. 1 and 2, the wire 34 may be embedded within an outer cover 33 of the second lanyard 14. The wire 34 can be connected to the plug 36 and the headset 38. The wire 34 can provide audio transmission between the first end 30, the second end 32, and the components thereon.

The plug 36 can be carried by the second lanyard 14 and adapted to connect to the audio device 11. As the audio device 11 is illustrated as a cellular phone in FIG. 2, the plug 36 is illustrated as being adapted for connection to a cellular phone. However, it will be understood that, as the audio device 11 can be any type of portable audio device, the plug 36 can be adapted for connection to any type of portable audio device.

The headset 38 can also be carried by the second lanyard 14. As the plug 36 is illustrated in FIGS. 1 and 2 as being adapted for connection to a cellular phone, the headset 38 is illustrated in FIGS. 1 and 2 as being adapted for use with a cellular phone. The headset 38 is shown as including an earpiece 40 and a microphone 42. The earpiece 40 can output audio from the phone to the user, and the microphone 42 can input audio to the phone from the user. The outer cloth cover of the lanyard 14 may extend to the earpiece 40. In this regard, in certain applications the outer cloth cover may conceal/cover the microphone 42. Again, it will be understood, however, that the teachings of the present disclosure are intended to be used with a variety of audio output devices, including but not limited to headsets, headphones, and similar devices.

The lanyard assembly 10 may further include a fastening arrangement 24. The fastening arrangement 24 may secure the free ends 30 and 32 of the secondary lanyard 14 to the primary lanyard 12. The fastening arrangement 24 may include first and second cooperating components 25 and 26. The first component 25 may be carried on the primary lanyard 12. As illustrated, the first component 25 is carried on the primary lanyard 12 proximate the first and second ends 16 and 18. The first component 25 may be crimped or otherwise securely fastened to the primary lanyard 12.

The second component 26 may be carried on the secondary lanyard 14. According to the teachings of the present disclosure, the second component 26 may be carried proximate one of the ends 30 and 32 of the secondary lanyard 14. In the embodiment illustrated, the second component 26 is crimped or otherwise securely fastened to the secondary lanyard 14 proximate the first end 30. Further in the embodiment illustrated, a third cooperating component 27 is crimped or otherwise securely fastened to the secondary lanyard 14 proximate the second end 32.

As stated above, the fastening arrangement 24 operates to removably secure the first and second ends 30 and 32 to the first lanyard 12. More specifically, the first component 25 of the fastening arrangement 24 is capable of engaging the second component 26 and the third component 27. According to the teachings of the present disclosure, a user can disengage the second component 26 and the third component 27 from the first component 25. When the second component 26 is disengaged from the first component 25, the first end 30 of the second lanyard 14 is detached from the first lanyard 12 so that the first end 30 can be maneuvered and positioned as desired, such as for engaging the plug 36 with the audio device 11. Similarly, when the third component 27 is disengaged from the first component 25, the second end 32 is detached from the first lanyard 12 and can be maneuvered and positioned as desired, such as for positioning the headset 38 proximate the head of a user. When the first and second ends 30 and 32 are attached to the first lanyard 12 by engaging the second and third components 26 and 27 with the first component 25, the second lanyard 14 can be secured to the first lanyard 12 by at least the fastening arrangement 24 and the connection 44, thus problems such as entangling can be avoided. Additionally, when the second and third components 26 and 27 are engaged with the first component 25, the plug 36 and the headset 38 can be stowed in known and accessible positions.

According to the teachings of the present disclosure, the fastening arrangement 24 and the components thereof can comprise a variety of materials and configurations. For example, the fastening arrangement 24 and the components thereof can comprise magnets and cooperating components, complementary hook and loop materials (such as VELCRO®), and snaps. It will be understood, however, that the teachings of the present disclosure are intended to be used with a variety of fasteners and fastening materials, including but not limited to these examples. In one particular embodiment, the first component 25 may be constructed of a magnetic material. In this embodiment, the second and third components 26 and 27 may be constructed of an iron based material or other material attracted by the magnetic material. The second and third components 26 and 27 may be disposed below. The outer cloth cover of the secondary lanyard 14.

The secondary lanyard 14 may be secured to the first lanyard 12 independent of the fastening arrangement 24. The first lanyard 12 and the second lanyard 14 can be secured by a connection 44. As illustrated in FIGS. 1 and 2, the connection 44 can be located distant the first and second ends 30 and 32 of the second lanyard 14. The connection 44 may function to permanently or temporarily secure the first and second lanyards 12 and 14 to one another. The connection 44 may include stitching, snaps, hook and loop type material, or other connections well known in the art. When both the first and second ends 30 and 32 of the second lanyard 14 are detached, the second lanyard 14 can remain secured to the first lanyard 12 by at least the connection 44, thus the lanyard assembly 10 can remain intact.

Figure 3:
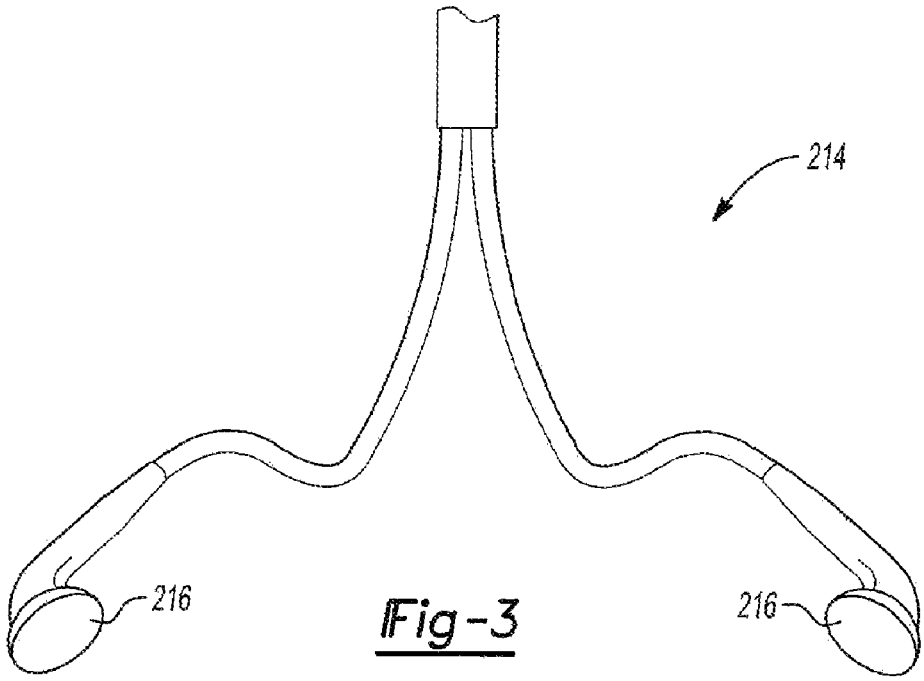
FIG. 3 illustrates an end of an alternative secondary lanyard, the alternative secondary lanyard illustrated to include a pair of earpieces suitable for stereo listening of a portable audio device.
Figure 4:
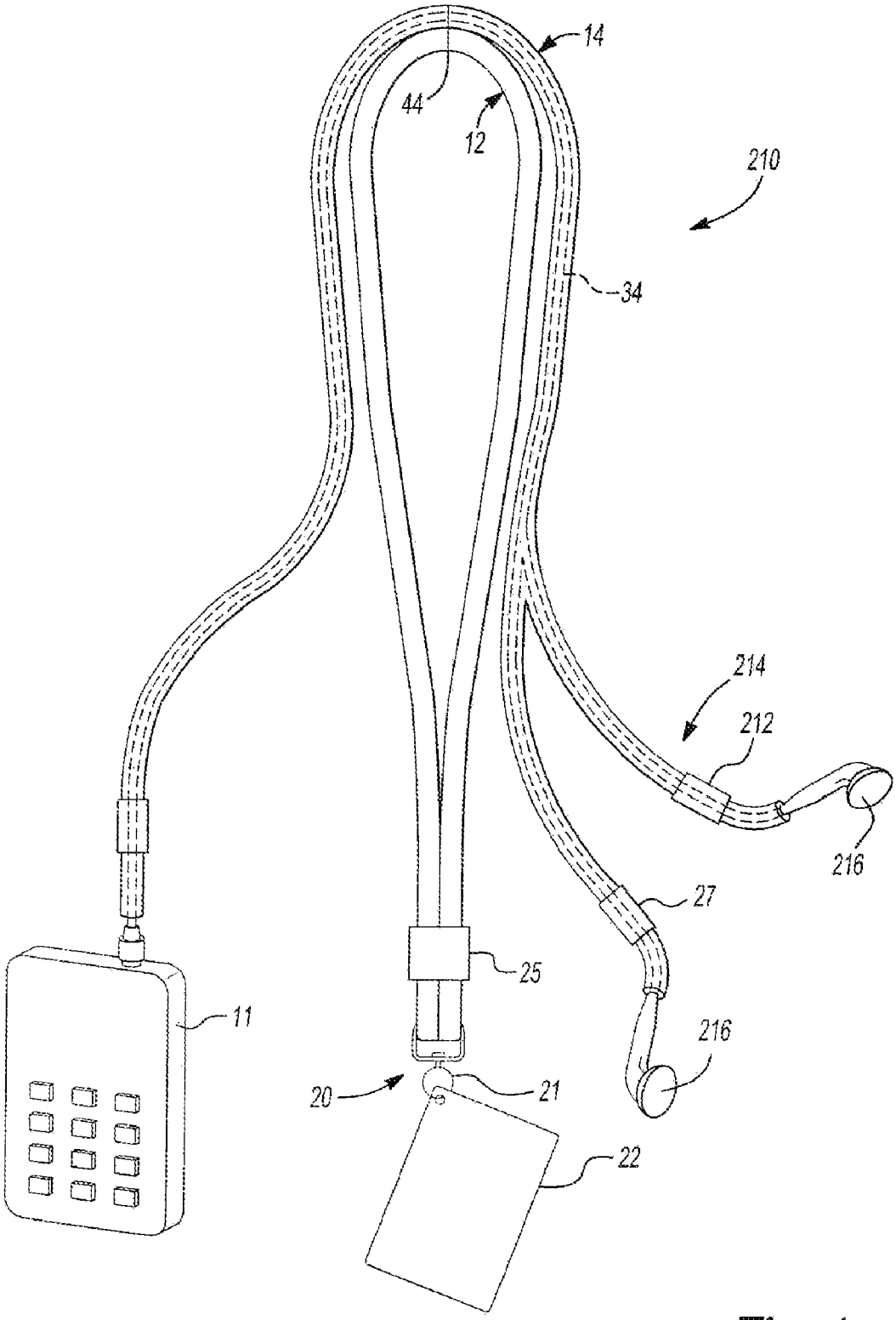
FIG. 4 illustrates an alternative lanyard assembly constructed in accordance with the teachings of the present disclosure, first and second ends of a secondary lanyard detached from the primary lanyard, the second end having first and second sections, and the secondary lanyard operatively associated with an alternative portable audio device.

Turning to FIGS. 3 and 4, another lanyard assembly constructed in accordance with the present disclosure is illustrated and identified at reference character 210. Like reference characters are used through FIGS. 3 and 4 to identify similar components previously introduced with respect to the embodiment of FIGS. 1 and 2. The lanyard assembly 210 differs from the lanyard assembly 10 by including an end 214 that may have a pair of earpieces 216. The pair of earpieces 216 may provide stereo sound for stereo listening of a portable audio device.

The fastening arrangement 24 of the lanyard assembly 210 additionally includes a fourth cooperating component 212. The third component 27 is associated with one of the earpieces 216 and the fourth component 212 is associated with the other of the earpieces 216. The components 27 and 212 may be constructed and attached in any of the forms discussed above with respect to the embodiment of FIGS. 1 and 2.

Figure 5:
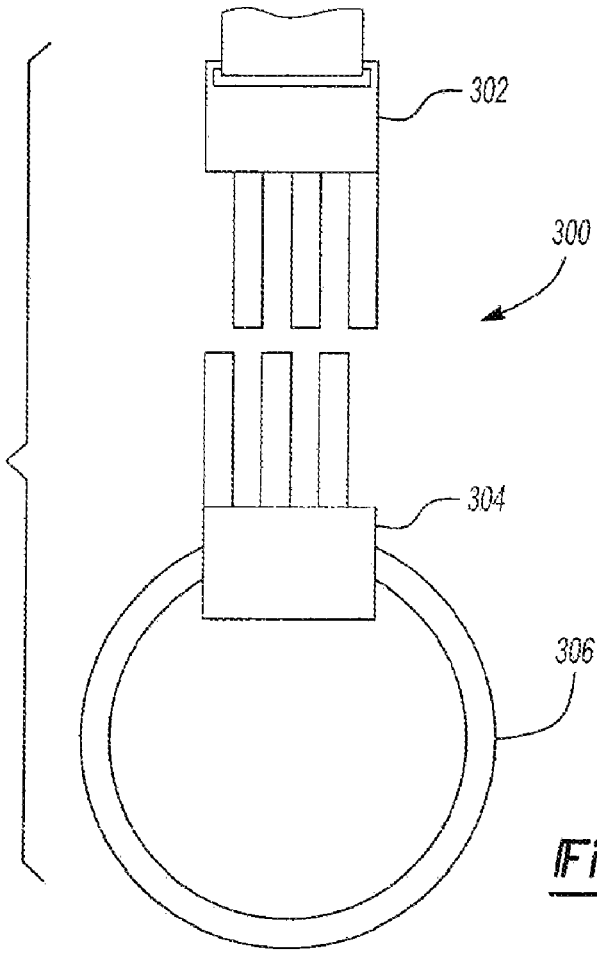
FIG. 5 illustrates an alternative attachment assembly having a removable support for a portable audio device.

Referring now to FIG. 5, an alternative attachment assembly is illustrated and identified at reference character 300. The assembly 300 includes first and second cooperating components 302 and 304. The first component 302 is carried by one of the lanyards 12 or 14. The second component 304 clips to or otherwise removably secures to the first component 302. The second component 304 carries support member 306. The support 306 is provided to help position a portable audio device 11 proximate a lanyard assembly 10 or 210. The support member 306 may be elastic. In this regard, the support member can comprise a rubber band 306. The rubber band 306 may have a width of approximately 0.5-1.0 inches and may be sized to flexibly receive various portable audio devices 11. Other dimensions may be utilized within the scope of the present invention. It will be understood that the teachings of the present disclosure are intended to be used with a variety of other supports and clips.

Figure 6:
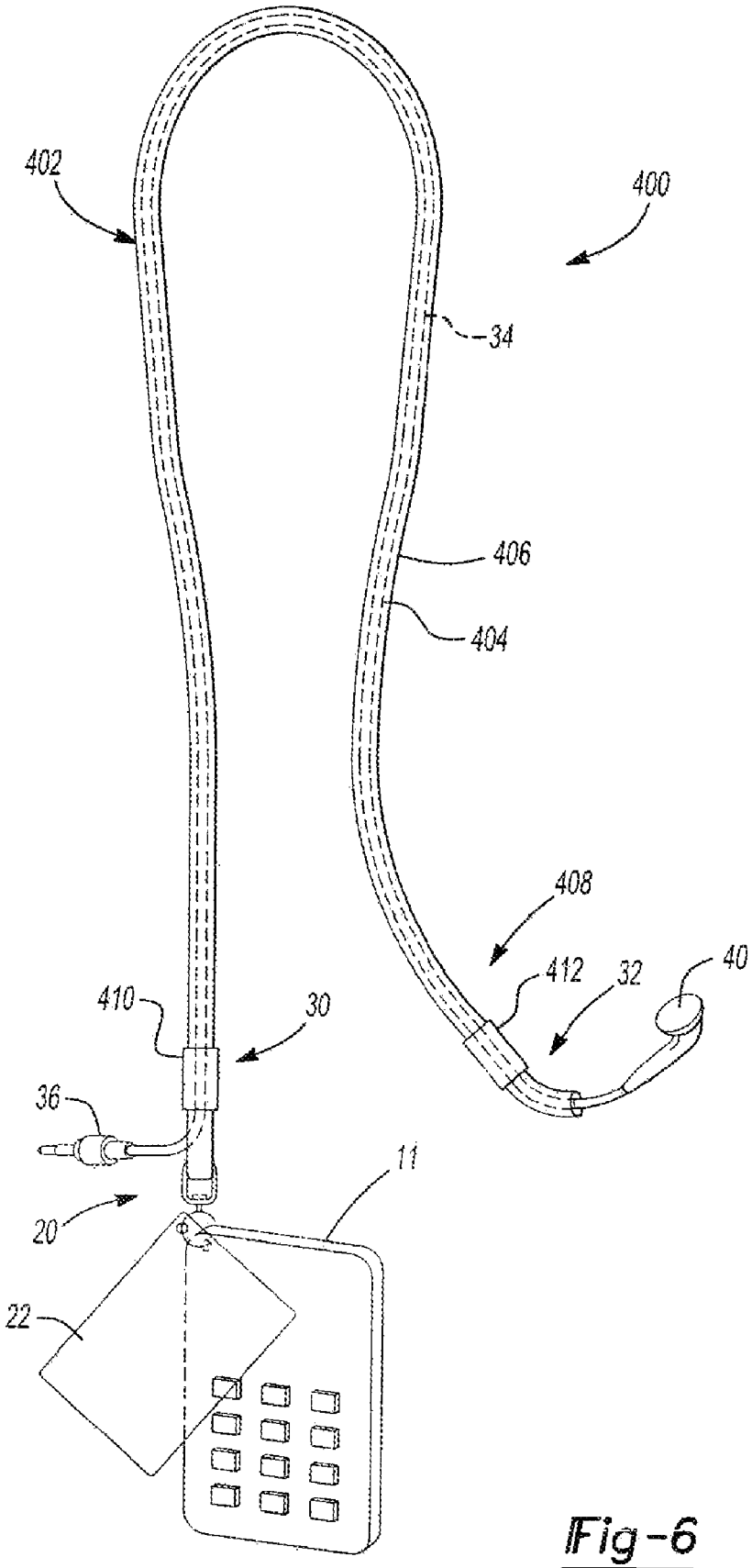
FIG. 6 is a view of another lanyard assembly constructed in accordance with the teachings of the present disclosure.

Turning to FIG. 6, another lanyard assembly constructed in accordance with the teachings of the present invention is illustrated. The lanyard assembly is generally identified at reference character 400. Again, like reference characters are utilized to identify elements similar to those introduced above.

In this embodiment, the lanyard assembly 400 includes a single lanyard 402. The lanyard 402 includes a conventional cord 404 that may be covered by a cloth covering 406. The cord 404 is weight bearing and may be connected to an attachment assembly 20 for carrying an ID card 22, for example.

The lanyard 402 includes a first end 30 and a second end 32. A wire 34 is embedded in the lanyard 402 for providing audio transmission. A first end of the wire 34 extends from the lanyard 402 proximate the first end 30 and is coupled to a plug 36 for engaging an audio device. A second end of the wire 34 extends from the lanyard 402 proximate the second end 32 and is coupled to at least one earbud 40.

The lanyard assembly 400 includes a fastening arrangement 408 having first and second cooperating components 410 and 412. The fastening arrangement 408 operates to removable couple the first and second ends 30 and 32 to one another. As discussed above, the components 410 and 412 may be constructed of a variety of materials. In one particular embodiment, one of the components may be constructed of a magnetic material and the other component constructed of an iron based or other material attracted by the magnetic material. The components 410 and 412 may be positioned below the cloth cover 406 of the lanyard 402.

In use, the lanyard 402 is worn around a neck of a user. The cooperating components 410 and 412 serve to couple the ends 30 and 32. A portable audio device 11 may be carried by the attachment assembly 20. When it is desired to listen to the portable audio device 11, the user uncouples the cooperating components 410 and 412. The plug 26 is inserted into the audio device and the earpiece 40 into the user's ear.

In certain applications, it may be desirable to add an additional plug (not specifically shown) to the secondary lanyard 14. The additional plug would be disposed beneath the outer cloth cover and would allow the wire 34 to be removed for washing of the lanyard assembly 10.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A lanyard assembly comprising:

a primary lanyard adapted to be worn around the neck of a user;

a secondary lanyard positioned proximate the primary lanyard, the secondary lanyard including a wire for providing audio transmission;

a plug carried by the secondary lanyard proximate a first end of the secondary lanyard and connected to the wire;

an audio output device carried by the secondary lanyard proximate a second end of the secondary lanyard and connected to the wire; and a fastening arrangement carried by the lanyard assembly, the fastening arrangement including first and second cooperating fastening components, the first fastening component carried on the primary lanyard, the second fastening component carried on the secondary lanyard proximate one of the plug and the audio output device;

wherein the user can selectively engage and disengage the first fastening component with the second fastening component.

2. The lanyard assembly of claim 1 wherein the audio output device includes at least one earpiece.

3. The lanyard assembly of claim 2 wherein the audio output device includes a first earpiece and a second earpiece.

4. The lanyard assembly of claim 3 wherein the second fastening component is carried by the secondary lanyard proximate the first earpiece and the fastening arrangement further comprises a third fastening component carried by the secondary lanyard proximate the second earpiece.

5. The lanyard assembly of claim 4 wherein the fastening arrangement further includes a fourth fastening component carried on the secondary lanyard proximate the plug.

6. The lanyard assembly of claim 3 wherein the audio output device is adapted to broadcast a stereo signal.

7. The lanyard assembly of claim 2 wherein the fastening arrangement further includes a third fastening component carried on the secondary lanyard proximate the other of the plug and the audio output device.

8. The lanyard assembly of claim 2 further comprising an audio input device carried by the secondary lanyard, disposed proximate the audio output device, and connected to the wire, and wherein the audio output device and the audio input device are adapted for use with a cellular phone.

9. The lanyard assembly of claim 1 wherein the plug is adapted to connect to a portable audio device.

10. The lanyard assembly of claim 9 wherein the plug is adapted to connect to a cellular phone.

11. The lanyard assembly of claim 9 wherein the plug is adapted to connect to a compact disc player.

12. The lanyard assembly of claim 9 wherein the plug is adapted to connect to a digital music player.

13. The lanyard assembly of claim 1 further comprising an attachment assembly carried by the primary lanyard for coupling an accessory component to the primary lanyard.

14. The lanyard assembly of claim 13 wherein the accessory component is an identification card.

15. The lanyard assembly of claim 1 wherein the fastening arrangement further includes a third fastening component carried on the secondary lanyard proximate the other of the plug and the audio output device.

16. The lanyard assembly of claim 1 wherein the primary lanyard is fixedly secured to the secondary lanyard distant the first and second ends of the secondary lanyard.

17. The lanyard assembly of claim 1 wherein at least one of the first fastening component and the second fastening component is a magnet.

18. The lanyard assembly of claim 1 wherein the first fastening component is one of a hook material and a loop material and the second fastening component is the other of the hook material and the loop material.

19. The lanyard assembly of claim 1 wherein the first fastening component and the second fastening component are snaps.

20. A lanyard assembly comprising:

a lanyard adapted to be worn around the neck of a user, the lanyard including a wire for providing audio transmission;

a plug carried by the lanyard proximate a first end of the lanyard and connected to the wire;

an audio output device carried by the lanyard proximate a second end of the lanyard and connected to the wire; and a fastening arrangement carried by the lanyard, the fastening arrangement including first and second cooperating fastening components, the first fastening component carried proximate the first end of the lanyard, the second fastening component carried proximate the second end of the lanyard;

wherein the user can selectively engage and disengage the first fastening component with the second fastening component.

* * * * *